US007624799B2

(12) United States Patent
Myhre et al.

(10) Patent No.: US 7,624,799 B2
(45) Date of Patent: Dec. 1, 2009

(54) ROTATIONALLY LOCKED WEAR SLEEVE FOR THROUGH-TUBING DRILLING AND COMPLETION

(75) Inventors: Morten Myhre, Tananger (NO); Jarle Haga, Royneberg (NO); Arne Gunnar Larsen, Sandnes (NO); Harold Downham, Sandnes (NO)

(73) Assignee: Baker Hughes Incorporated, Houston, TX (US)

( * ) Notice: Subject to any disclaimer, the term of this patent is extended or adjusted under 35 U.S.C. 154(b) by 324 days.

(21) Appl. No.: 11/042,422

(22) Filed: Jan. 25, 2005

(65) Prior Publication Data

US 2005/0161214 A1 Jul. 28, 2005

Related U.S. Application Data

(60) Provisional application No. 60/539,396, filed on Jan. 27, 2004.

(51) Int. Cl.
*E21B 17/10* (2006.01)

(52) U.S. Cl. ..... 166/242.1; 166/242.4

(58) Field of Classification Search ..... 166/242.1, 166/242.4

See application file for complete search history.

(56) References Cited

U.S. PATENT DOCUMENTS

| | | | | |
|---|---|---|---|---|
| 1,762,211 | A | | 6/1930 | Bradford |
| 2,751,235 | A | | 6/1956 | Watts et al. |
| 2,754,136 | A | | 7/1956 | Phillips |
| 3,244,424 | A | | 4/1966 | Cope |
| 4,103,748 | A | | 8/1978 | Arnold |
| RE30,647 | E | | 6/1981 | Blouse |
| 4,298,221 | A | | 11/1981 | McGugan |
| 4,373,750 | A | | 2/1983 | Mantelle et al. |
| 4,561,683 | A | | 12/1985 | Lumsden et al. |
| 4,573,540 | A | | 3/1986 | Dllinger et al. |
| 4,899,816 | A | | 2/1990 | Mine |
| 5,082,061 | A | * | 1/1992 | Dollison ..... 166/378 |
| 5,180,008 | A | | 1/1993 | Aldridge et al. |
| 5,360,063 | A | | 11/1994 | Henderson, Jr. |
| 5,681,059 | A | | 10/1997 | Mackie |
| 5,709,417 | A | | 1/1998 | Verbeck |
| 5,738,388 | A | | 4/1998 | Sundelin |
| 5,954,374 | A | | 9/1999 | Gallagher et al. |
| 5,964,486 | A | | 10/1999 | Sinclair |
| 6,024,172 | A | | 2/2000 | Lee |

(Continued)

FOREIGN PATENT DOCUMENTS

| | | |
|---|---|---|
| WO | WO 98/38411 | 9/1998 |

OTHER PUBLICATIONS

Lewis, Sterling, et al., "Requirements for a Full Drill through Subsea Wellhead and Tree System",IADC/SPE 112723, Mar. 2008, 1-7.

(Continued)

*Primary Examiner*—Jennifer H Gay
*Assistant Examiner*—Brad Harcourt
(74) *Attorney, Agent, or Firm*—Steve Rosenblatt

(57) ABSTRACT

A protective sleeve can be inserted through tubing and latched in a manner that resists rotation. At the conclusion of the through tubing operation that involves rotational movement, the sleeve is withdrawn on the string that previously extended through it.

20 Claims, 3 Drawing Sheets

U.S. PATENT DOCUMENTS

| | | | | |
|---|---|---|---|---|
| 6,039,129 | A * | 3/2000 | McLeod | 175/258 |
| 6,056,051 | A * | 5/2000 | Coronado | 166/134 |
| 6,056,324 | A | 5/2000 | Reimert et al. | |
| 6,409,175 | B1 | 6/2002 | Evans et al. | |
| 6,419,026 | B1 | 7/2002 | MacKenzie et al. | |
| 6,527,049 | B2 * | 3/2003 | Metcalfe et al. | 166/277 |
| 6,554,287 | B1 | 4/2003 | Sivley, IV et al. | |
| 6,561,279 | B2 | 5/2003 | MacKenzie et al. | |
| 6,626,471 | B2 | 9/2003 | Mallis | |
| 7,387,158 | B2 | 6/2008 | Murray et al. | |
| 2003/0155159 | A1 * | 8/2003 | Slack et al. | 175/423 |
| 2003/0234538 | A1 | 12/2003 | Hashem | |

OTHER PUBLICATIONS

Welch, William R., et al., "Nonelastomeric Sliding Sleeve Maintains Long Term Integrity in HP/HT Application: Case Histories", SPE 37357, Oct. 1996, 219-228.

True, Martin E., et al., "Optimum Means of Protecting Casing and Drillpipe Tool Joints Against Wear", Journal of Petroleum Technology, Feb. 1975, 246-252.

Tistel, Jan Ivar, et al., "Through-Tubing Rotary Drilling from Njord Floating Platform", SPE Drilling and Completion, Dec. 2007, 313-325.

* cited by examiner

ROTATIONALLY LOCKED WEAR SLEEVE FOR THROUGH-TUBING DRILLING AND COMPLETION

PRIORITY INFORMATION

This application claims the benefit of U.S. Provisional Application No. 60/539,396, filed on Jan. 27, 2004.

FIELD OF THE INVENTION

The field of the invention is protection devices for seal bores or other sensitive areas in tubing through which drilling or other completion procedures that involve rotation take place.

BACKGROUND OF THE INVENTION

Tubular strings now experience rotational movement of a through tubing drill string. Other completion operations could also involve rotation. Many types of devices that are part of the tubular string have internal seal bores or other sensitive areas that can be damaged by the whip action of the through tubing rotating string. In the past, various solutions have been attempted. In one design, the seal bores are recessed so that the whip motion of the string or the running in and out of the hole on a wireline does not damage the recessed seal bore. An example of such a design is U.S. Pat. No. 5,865,255. Recessing the seal bore then requires equipment able to spread the seals of subsequent equipment introduced into the tubing and designed to seal against the seal bore.

Protective sleeves have been tried to overlay the seal bore but the problem with them was that they were not rotationally locked and the whip action of the through tubing drill string making contact with such a protective sleeve, either eroded it away by spinning it or got the protective sleeve so hot from rotation that it fused itself to the seal bore. This effect ruined the seal bore and made the protective sleeve effectively non-removable.

The problem that has not been addressed by the prior designs has been how to make a removable protective sleeve that is rotationally locked, simple to install before the through tubing operation and just as simple to remove after the through tubing operation when access to the seal bore was needed. The preferred embodiment described below provides the solution for a sleeve that goes in or out simply and is locked rotationally when in place.

The following U.S. patents are generally related to the use of internal seal bores and the sealing assemblies that can engage them: U.S. Pat. Nos. 1,762,211; 2,751,235; 2,754,136; 3,244,424; 4,899,816; 5,180,008 and 6,024,172.

Those skilled in the art will better understand the various embodiments from a description of the preferred embodiment and the drawings that appear below, with the claims defining the full scope of the invention.

SUMMARY OF THE INVENTION

A protective sleeve can be inserted through tubing and latched in a manner that resists rotation. At the conclusion of the through tubing operation that involves rotational movement, the sleeve is withdrawn on the string that previously extended through it.

DETAILED DESCRIPTION OF THE PREFERRED EMBODIMENT

Figure 1:
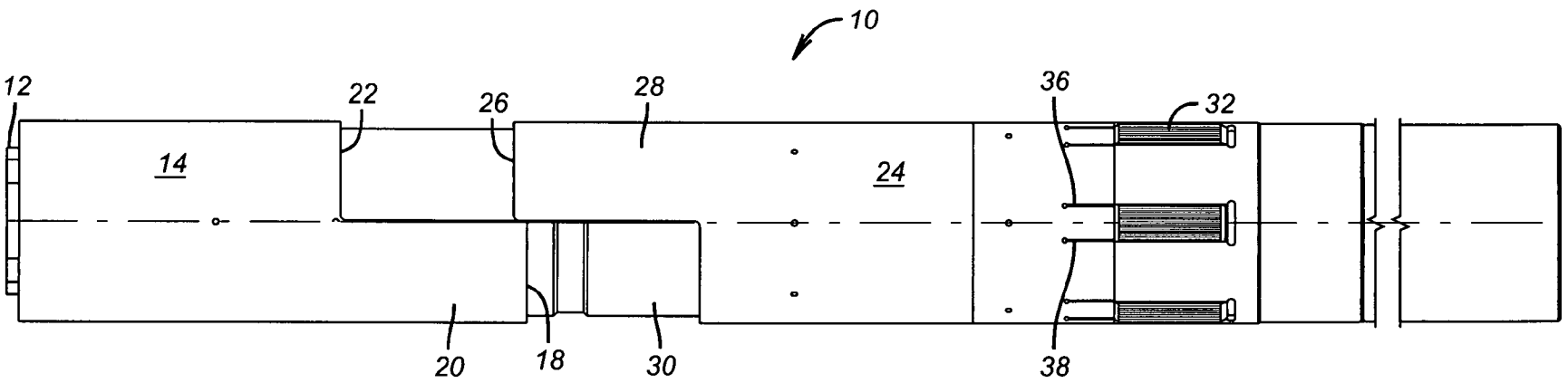
FIG. 1 is an exterior view of the protective sleeve in the run in position.
Figure 4:
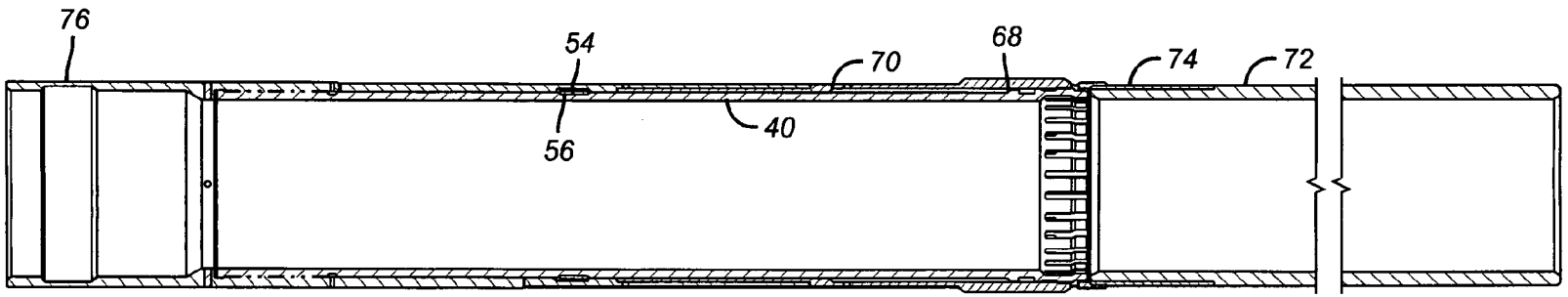
FIG. 4 is a section view of FIG. 3 shown with the internal string removed for clarity with the protective sleeve in a position where it can be removed.
Figure 6:
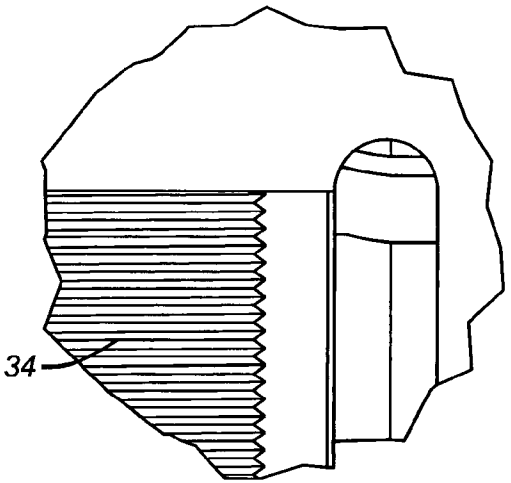
FIG. 6 is a detailed view of one of the dogs.

FIG. 1 shows the protective sleeve assembly 10 supported by a sub 12 that is part of the through tubing string (not shown). The protective sleeve assembly 10 has an upper member 14 that is secured to sub 12 for run in with a shear pin 16. Member 14 is castellated at its lower end 18 by virtue of alternating fingers 20 with gaps 22 in between them. Lower member 24 has an upper end 26 that is castellated with fingers 28 separated by gaps 30. Lower member 24 has a plurality of flexible dogs 32 that have longitudinally oriented wickers 34, shown in FIG. 6, to provide resistance to rotation. These dogs 32 are preferably made integrally to lower member 24 by a pair of longitudinal cuts 36 and 38 so that dogs 32 can flex inwardly during run in and move outwardly when supported by inner sleeve 40, as shown in FIG. 4. Inner sleeve 40 is secured to upper member 14 at thread 42, as shown in FIG. 2.

Figure 5:
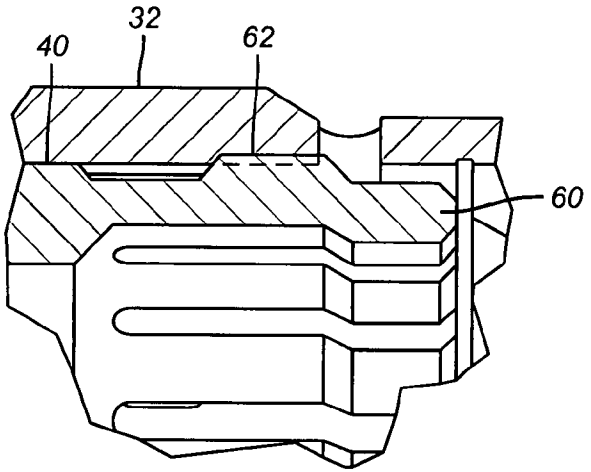
FIG. 5 is a detailed view of the dogs in the latched and fully supported position that is otherwise shown in FIG. 3.
Figure 7:
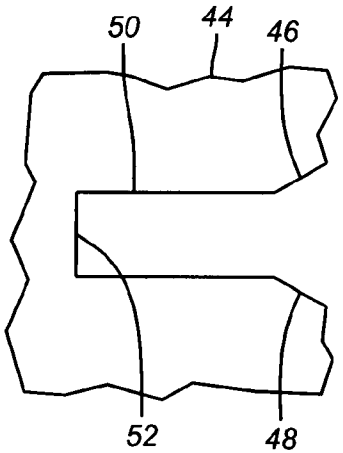
FIG. 7 is an inside view of the tubular in which the protective sleeve will be mounted showing the longitudinal grooves that can provide the rotational locking.

In the run in sequence, the dogs 32 are unsupported as inner sleeve 40 is above them. The dogs 32 are free to be deflected inwardly as sub 12 is advanced. FIG. 7 shows a detail of the inside of the tubular 44. One assembly of many is shown with those skilled in the art knowing that there is one such assembly in FIG. 7 for each dog 32. Inclined surfaces 46 and 48 reorient and guide a respective dog 32 into a longitudinal through 50 in the tubular 44. When the dogs 32 respectively hit bottom 52 in the tubular 44 the lower member 24 no-goes. A further set down weight results in breaking of the shear pin 16. At that point the upper member 14 takes with it inner sleeve 40 as fingers 20 move into gaps 30 and fingers 28 enter gaps 22. When the upper member 14 is fully moved down, it is rotationally locked to the lower member 24. At the same time the inner sleeve 40 has moved down and become locked as C-ring 54 has come into alignment with groove 56. The lower end 58 of inner sleeve 40 has fingers 60 that snap into a recess 62 inside of dogs 32 as shown in FIG. 5. At this point the sleeve assembly 10 is installed and rotationally locked.

Figure 2:
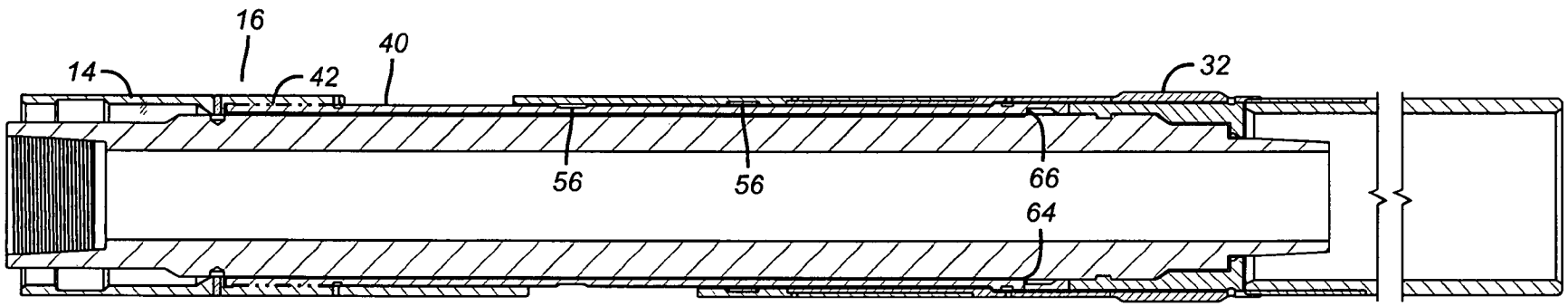
FIG. 2 is a section view through the protective sleeve in FIG. 1.
Figure 3:
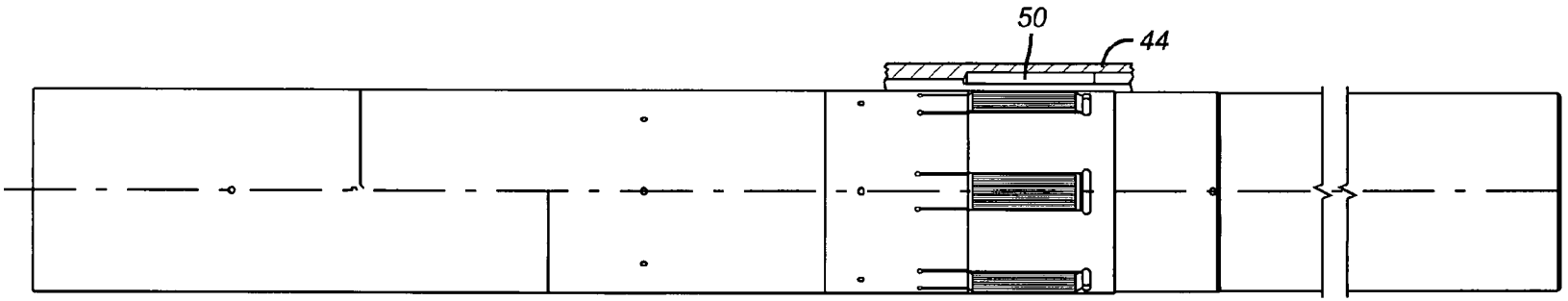
FIG. 3 is an exterior view of the protective sleeve in the latched position.

For retrieval, FIG. 2 shows a shoulder 64 on sub 12 that engages a shoulder 66 on inner sleeve 40. When sub 12 is moved up and these shoulders engage, the inner sleeve 40 is brought up with respect to lower member 24 that is still held to the tubular 44 by dogs 32. The upward movement of inner sleeve 40 undermines the dogs 32 as C-ring 54 comes out of groove 56. Eventually, a shoulder 68 in the inner sleeve 40 catches a shoulder 70 on the lower member 24 to pull the lower member 24 out of the tubular 44. Those skilled in the art will appreciate that lower member 24 can have an extension piece 72 attached at thread 74 to extend down for example into a subsurface safety valve to span the seal bores above and below a flow tube. The subsurface safety valve is not shown. Other type of equipment can be protected with the sleeve assembly 10.

The rotational locking can be accomplished by the presence and orientation of the wickers 34 on the dogs 32 acting alone. Alternatively, the dogs 32 can go into longitudinal troughs 50 to obtain the rotational locking feature. As another variation, these features can be combined. The castellation is but one execution of a feature in the preferred embodiment that allows the dogs 32 to be locked in place and then rotationally locks the portion of the device that translates to achieve the locking. In this case the inner sleeve 40, which is the piece of the assembly likely to get direct contact from an internal rotating string, is rotationally locked because of the castellation contact with the lower member 24, which is, in turn, secured to the tubular 44 in a manner that prevents rotation. The components that are threaded together such as for example at thread 74 can have the proper thread orientation so as not to become undone upon receiving impacts from the internal rotating string when the sleeve assembly is in place. Another feature of the device is that the dogs 32 when supported with sleeve 40 are locked in that position due to the interaction of C-ring 54 in groove 56. Should the retrieval of the sub 12 not result in release of the assembly 10, a fishing neck 76 is provided to assist in the removal in a separate run in the hole.

The foregoing disclosure and description of the invention are illustrative and explanatory thereof, and various changes in the size, shape and materials, as well as in the details of the illustrated construction, may be made without departing from the spirit of the invention.

We claim:

1. A protective covering for an exposed downhole tool surface, said surface having a longitudinal axis and located downhole below the topmost portion in a supporting tubular string, comprising:

a protective sleeve insertable downhole into and beyond said topmost portion of said tubular string for protecting the tool surface from a rotating tubular when in position and wherein said protective sleeve is subsequently removed intact through said topmost portion of said tubular string and wherein engagement between said tool surface and the rotating tubular is allowed after intact removal through said topmost portion of said tubular string;

a locking member for selective engagement of said protective sleeve to the downhole tool surface in a manner that prevents relative rotation between said protective sleeve and the downhole tool surface and permits a rotating tubular to engage said protective sleeve when selectively engaged to the downhole tool.

2. The covering of claim 1, wherein:

said locking member comprises wickers to engage the downhole tool.

3. The covering of claim 2, wherein:

said wickers are oriented substantially parallel to the longitudinal axis of the downhole tool surface.

4. The covering of claim 2, wherein:

said locking member enters a receptacle in the downhole tool to prevent rotation of said protective sleeve.

5. The covering of claim 1, further comprising:

an actuating member to selectively actuate said locking member, said actuating member becoming rotationally locked to said protective sleeve.

6. The covering of claim 5, wherein:

said locking member is prevented from advancing when engaging a travel stop on the downhole tool;

whereupon said actuating member moves with respect to said locking member to give it support to rotationally lock said protective sleeve to the downhole tool.

7. The covering of claim 6, wherein:

said actuating member and said protective sleeve rotationally lock by virtue of at least one projection moving into engagement with at least one depression.

8. The covering of claim 7, wherein:

said locking member comprises at least one collet connected to said protective sleeve.

9. The covering of claim 5, further comprising:

a mandrel to support said protective sleeve, said actuating member and said locking member for placement into the downhole tool;

said mandrel moving in tandem with said sleeves and locking member until said locking member can advance no further from contact with the downhole tool, whereupon said mandrel advances said actuating member with respect to said protective sleeve to actuate said locking member to rotationally lock said protective sleeve to the downhole tool.

10. The covering of claim 9, wherein:

advancing of said actuating member longitudinally by said mandrel rotationally locks said actuating member to said protective sleeve.

11. A protective covering for a downhole tool surface said surface having a longitudinal axis, comprising:

a protective sleeve;

a locking member for selective engagement of said protective sleeve to the downhole tool in a manner that prevents relative rotation between said protective sleeve and the downhole tool surface;

an actuating member to selectively actuate said locking member, said actuating member becoming rotationally locked to said protective sleeve;

said locking member is prevented from advancing when engaging a travel stop on the downhole tool;

whereupon said actuating member moves with respect to said locking member to give said locking member support to rotationally lock said protective sleeve to the downhole tool;

said actuating member and said protective sleeve rotationally lock by virtue of at least one projection moving into engagement with at least one depression;

said locking member comprises at least one collet connected to said protective sleeve;

said actuating member is disposed out of contact with said collet for run in to allow it to flex, whereupon actuation of said actuating member it moves adjacent said collet to provide support for said protective sleeve against rotational impacts.

12. The covering of claim 11, wherein:

said actuating member releasably latches to said protective sleeve when supporting said collet.

13. The covering of claim 11, wherein:

said actuating member releasably latches to the downhole tool when supporting said collet.

14. The covering of claim 11, wherein:

said actuating member further comprises a first engagement location to facilitate moving it to a position where said collet is not supported.

15. The covering of claim 14, wherein:

said protective sleeve comprises a second engagement location for contact with said actuating member when said collet is not supported for removal of said protective sleeve.

16. A protective covering for an exposed downhole tool surface, said surface having a longitudinal axis and located downhole below the topmost portion in a supporting tubular string, comprising:

a protective sleeve insertable downhole into and beyond said topmost portion to said tool surface and subsequently removable from engagement with the tool surface for protecting the tool surface from a rotating tubular when in position and for allowing engagement of the tool surface after removal of said protective sleeve;

a locking member for selective engagement of said protective sleeve to the downhole tool surface in a manner that prevents relative rotation between said protective sleeve and the downhole tool surface and permits a rotating tubular to engage said protective sleeve when selectively engaged to the downhole tool;

an actuating member to selectively actuate said locking member, said actuating member becoming rotationally locked to said protective sleeve;

a mandrel to support said protective sleeve, said actuating member and said locking member for placement into the downhole tool;

said mandrel moving in tandem with said sleeves and locking member until said locking member can advance no further from contact with the downhole tool, whereupon said mandrel advances said actuating member with respect to said protective sleeve to actuate said locking member to rotationally lock said protective sleeve to the downhole tool;

advancing of said actuating member longitudinally by said mandrel rotationally locks said actuating member to said protective sleeve;

locking said actuating member to said protective sleeve releases said actuating member from said mandrel;

said locking member comprises at least one collet connected to said protective sleeve, said actuating member supporting said collet for engagement with the downhole tool to rotationally lock said protective sleeve.

17. The covering of claim 16, wherein:

said collet comprises wickers oriented substantially parallel to the longitudinal axis of the downhole tool surface to engage the downhole tool.

18. The covering of claim 16, wherein:

said collet enters a receptacle in the downhole tool to prevent rotation of said protective sleeve.

19. A protective covering for an exposed downhole tool surface, said surface having a longitudinal axis and located downhole below the topmost portion in a supporting tubular string, comprising:

a protective sleeve insertable downhole into and beyond said topmost portion to said tool surface and subsequently removable from engagement with the tool surface for protecting the tool surface from a rotating tubular when in position and for allowing engagement of the tool surface after removal of said protective sleeve;

a locking member for selective engagement of said protective sleeve to the downhole tool surface in a manner that prevents relative rotation between said protective sleeve and the downhole tool surface and permits a rotating tubular to engage said protective sleeve when selectively engaged to the downhole tool;

an actuating member to selectively actuate said locking member, said actuating member becoming rotationally locked to said protective sleeve;

a mandrel to support said protective sleeve, said actuating member and said locking member for placement into the downhole tool;

said mandrel moving in tandem with said sleeves and locking member until said locking member can advance no further from contact with the downhole tool, whereupon said mandrel advances said actuating member with respect to said protective sleeve to actuate said locking member to rotationally lock said protective sleeve to the downhole tool;

said protective sleeve and said actuating member have castellations which selectively engage to rotationally lock them together.

20. The covering of claim 19, wherein:

said actuating member is movable to release said locking member and subsequently engage said protective sleeve for removing it from the downhole tool.

* * * * *